US007308897B2

(12) United States Patent
Russell, II et al.

(10) Patent No.: US 7,308,897 B2
(45) Date of Patent: Dec. 18, 2007

(54) CIGAR OPENER

(76) Inventors: Orlando Willie Russell, II, 20221 McCormick, Detroit, MI (US) 48224; Randy Gray, II, 16184 Prest, Detroit, MI (US) 48235

( * ) Notice: Subject to any disclaimer, the term of this patent is extended or adjusted under 35 U.S.C. 154(b) by 484 days.

(21) Appl. No.: 10/710,977

(22) Filed: Aug. 16, 2004

(65) Prior Publication Data

US 2005/0045196 A1 Mar. 3, 2005

Related U.S. Application Data

(60) Provisional application No. 60/497,639, filed on Aug. 25, 2003.

(51) Int. Cl.
*A24F 13/24* (2006.01)

(52) U.S. Cl. ..... 131/253; 131/254

(58) Field of Classification Search ..... 131/233, 131/248, 252, 253, 254, 255; D27/195
See application file for complete search history.

(56) References Cited

U.S. PATENT DOCUMENTS

| | | | | | |
|---|---|---|---|---|---|
| 1,434,599 | A * | 11/1922 | Field et al. | ..... | 131/255 |
| 4,837,931 | A * | 6/1989 | Beermann | ..... | 30/92 |
| 5,836,318 | A * | 11/1998 | Adams | ..... | 131/253 |
| 6,032,679 | A * | 3/2000 | McGlauflin | ..... | 131/255 |
| 6,386,204 | B1 * | 5/2002 | Kontos | ..... | 131/250 |

* cited by examiner

*Primary Examiner*—Carlos Lopez
(74) *Attorney, Agent, or Firm*—John A. Artz; Dickinson Wright PLLC

(57) ABSTRACT

A cigar opener assembly (10) includes a cover (12) and blade housing (14) having a blade (16) therein. The cover (12) and blade housing (14) rotate relative to each other so that openings (22, 24) through the cover (12) align with a channel (38) within the blade housing (14). After use, the cover (12) may be rotated relative to the blade housing (14) so that the blade is no longer accessible.

28 Claims, 2 Drawing Sheets

CIGAR OPENER

CROSS REFERENCE TO RELATED APPLICATIONS

The present invention claims priority to provisional application 60/497,639, filed on Aug. 25, 2003.

BACKGROUND OF INVENTION

The present invention relates generally to a cutting tool, and more specifically, to a tool suitable for opening a cigar.

In recent years, cigars have become increasingly popular. Often times, cigars come in large sizes. Many times a cigar smoker does not smoke the entire cigar. Cigars can also be relatively expensive. Therefore, it is not desirable to waste even a portion of the cigar.

Another trend for cigar smokers is to roll their own cigars with their own rolling papers. Rolling papers come in a variety of styles and flavors to enhance the flavor of the cigar. To avoid waste, the cigar owner may find it desirable to open the cigar and divide the tobacco inside between a number of different and appropriately sized cigars.

To open a cigar, a knife may be used. A knife is typically not a very portable instrument due to the sharp blade associated therewith. Carrying a knife may pose a risk of injury a risk of injury may also present itself while using the knife to open the cigar.

It would therefore be desirable to provide a device for opening a cigar that is suitable for portability as well as reduces the potential for injury to the user.

SUMMARY OF INVENTION

The present invention provides a portable cigar opener that reduces the potential for injury during the opening process and during transportation of the device.

In one aspect of the invention, a cigar opener includes a blade housing having a first channel therethrough. The first channel has a blade disposed therein. A cover has a first opening and second opening therethrough. The blade housing is rotatable relative to the cover. The blade housing and the cover have a first position wherein the channel is aligned with the openings and a second position wherein the channel is not aligned with the openings.

In a further aspect of the invention, the blade housing has a first channel therethrough. The first channel has a blade disposed therein. A cover having a first opening and a second opening therethrough. The cover has a second channel therethrough. The channel housing is rotatable relative to the cover within the second channel about an axis of rotation. The first channel is perpendicular to the axis of rotation. The blade housing and said cover have a first position wherein the first channel is aligned with the openings and a second position wherein the channel is not aligned with the openings.

One advantage of the invention is that the blade remains protected within the cover when the openings are not aligned with the first channel to reduce the potential for injury. Another invention of the invention is that the cigar may be easily passed through the first channel and pulled through from the other side so that the cigar is easily opened.

Other advantages and features of the present invention will become apparent when viewed in light of the detailed description of the preferred embodiment when taken in conjunction with the attached drawings and appended claims.

DETAILED DESCRIPTION

Figure 1:
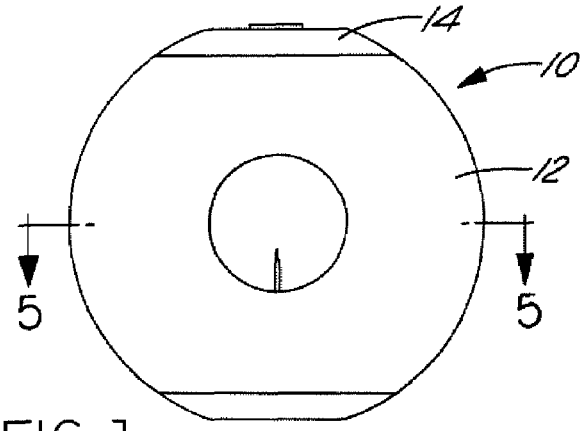
FIG. 1 is a front view of a cigar opener in an open position according to one embodiment of the invention.

In the following figures, the same reference numerals will be used to illustrate the same components.

The various shapes and relative positions of the device are presented for illustrative purposes only and should not be construed as limiting unless set forth in the claims.

Referring now to FIG. 1, a cigar opener assembly 10 having a cover 12 and a blade housing 14 with a blade 16 positioned therein is illustrated. The cover 12 and the blade housing 14 may be formed of a plastic material. Of course, other suitable materials may be used including metal, wood and the like. The blade 16 is preferably formed of a metal material and is sharpened to provide a cutting edge. Cover 12 is rotatable relative to blade housing 14 so that in a first position the blade 16 is accessible. In the second or closed position, the blade 16 is inaccessible to prevent inadvertent insertion of a finger and thus prevent potential injury.

Figure 2:
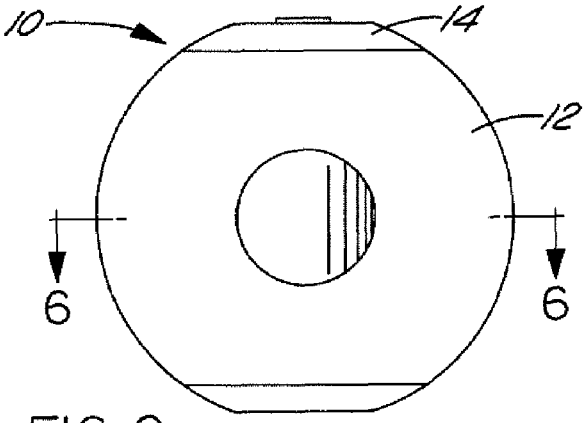
FIG. 2 is a front view of a cigar opener in a closed position according to the one embodiment of the invention.

Referring now to FIG. 2, the cover 12 is positioned in a manner so that the blade 16 therein is inaccessible.

Figure 3:
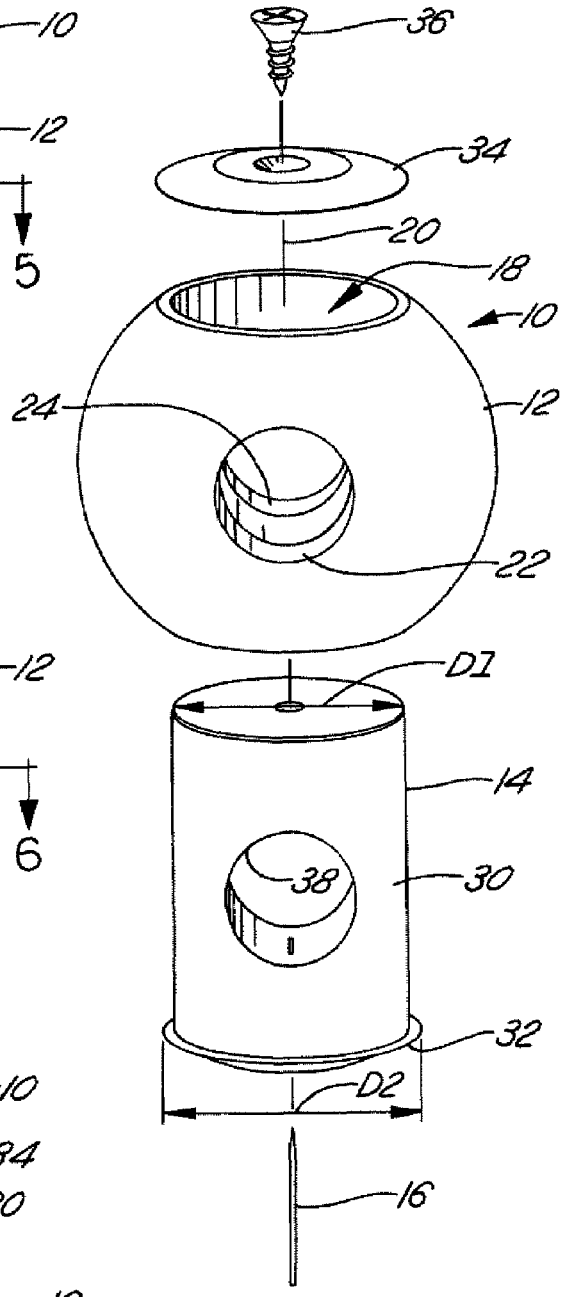
FIG. 3 is an exploded view of the cigar-opening device in FIGS. 1 and 2.

Referring now to FIG. 3, cover 12 is generally spherical in shape, various cover shapes would be evident to those skilled in the art. The cover 12 has a channel 18 therethrough. Channel 18 has a generally cylindrical shape and has a longitudinal axis 20. Cover 12 also has a first opening 22 and a second opening 24 therethrough. Preferably, openings 22 and 24 share a common central axis coinciding with the centers of the holes. Preferably, the axis is perpendicular to the longitudinal axis 20. However, as will be further described below in FIG. 7, the common axis of openings 22 to 24 need not be perpendicular to the longitudinal axis 20. Openings 22 and 24 are presently sized to receive the cigar therein. Openings 22, 24 may, for example, range from between one-half an inch to three-quarters of an inch.

Blade housing 14 has a generally cylindrical shaped portion 30 that is sized to be rotatably received within channel 18 of cover 12. That is, the diameter D1 of cylindrical shaped portion 30 is just smaller than the diameter of the channel 18.

The blade housing 14 also includes a first flange 32 and a second flange 34. The first flange 3 and the second flange 34 preferably have a diameter that is larger than the diameter D1 and the diameter of the channel 18. Although the diameter D2 is illustrated for both first flange 32 and second flange 34, the diameter of the flanges need not be the same.

The second flange 34 may be removably coupled to the cylindrical shaped portion 30 using a fastener 36 such as screw. Those skilled in the art will recognize that the second flange may be fixedly attached to the cylindrical shaped portion 30 in a commercial type embodiment to prevent the removal of the blade housing from the cover 12 after assembly.

The cylindrical shaped portion 30 has a channel 38 therethrough. Channel 38 preferably has a diameter the same or larger than the diameter of openings 22, 24. To make the device more aesthetically pleasing, the flanges 32, 34 may be slightly rounded to "finish off" the sphere of the cover 12 when assembled.

Figure 4:
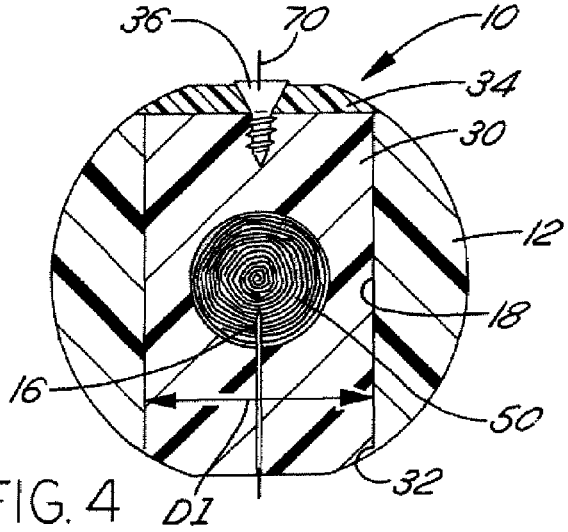
FIG. 4 is a cross-sectional view of the cigar-opening device with a cigar therein.

Referring now to FIG. 4, as can be seen, the blade 16 extends into a cigar 50 upon insertion of the cigar within the cigar opener assembly 10.

Figure 5:
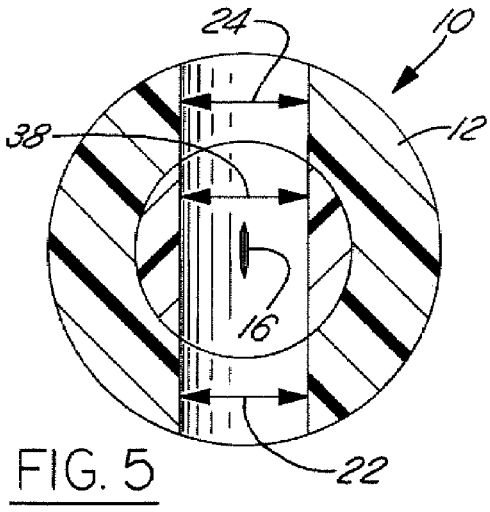
FIG. 5 is a cross-sectional view of the cigar-opening device in an open position.

Referring now to FIG. 5, a cross-sectional view of FIG. 1 is illustrated. In this figure, the openings 22, 24 are aligned with the channel 38 so that the cigar 50 contacts the blade 16 upon insertion into one of the openings 22, 24.

Figure 6:
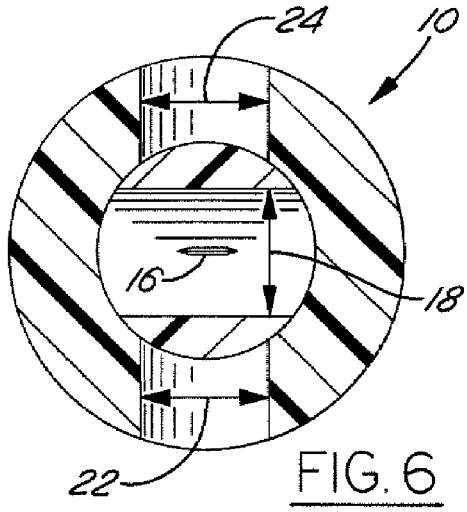
FIG. 6 is a cross-sectional view of the cigar-opening device in a closed position.

In FIG. 6, a cross-sectional view of FIG. 2 is illustrated in which the channel 18 is not aligned with the openings 22, 24. Therefore, in FIG. 6, the potential for injury is reduced.

Figure 7:
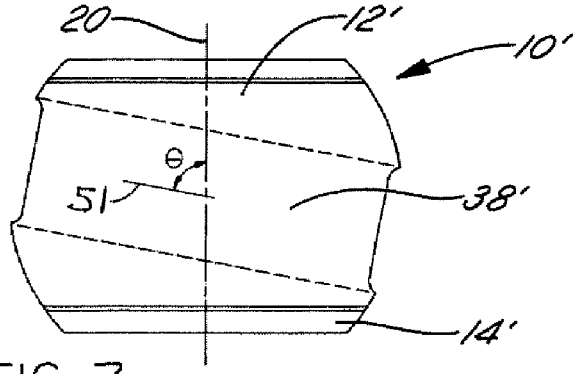
FIG. 7 is a side view of an alternative embodiment of the cigar opener of the present.

Referring now to FIG. 7, a first alternative embodiment of a cigar opener assembly 10" is illustrated. In this embodiment, channel 38" (the central axis 51 thereof) is illustrated at an angle θ relative to the rotational axis 20. Angle θ is less than 90 degrees.

Figure 8:
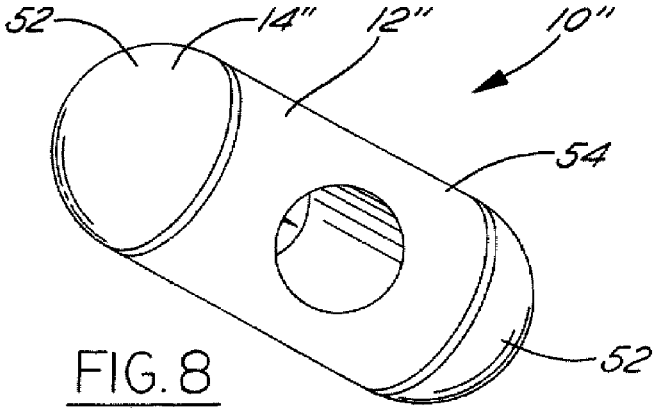
FIG. 8 is a second alternative embodiment of the cigar opener according to the present invention.

Referring now to FIG. 8, a second alternative embodiment of the cigar opener assembly 10"" is illustrated. In this example, an elongated blade housing 14"" is positioned within a cover 12"". The blade housing 14" has rounded ends 52 that have a generally cylindrical shaped central portion 54. The cover 12"" is also elongated to conform to the shape of the central portion so that the central portion 54 rotates therein.

The device may be assembled by inserting the cylindrical shaped portion 30 of the blade housing 14 into the channel 18 of the cover 12. The second flange 34 is positioned against the cylindrical shaped portion 30 and coupled by way of the fastener or other means.

To use the device, the cover 12 or the blade housing 14 is rotated so that the openings 22, 24 are aligned with the channel 38. The cigar 50 is placed through the openings 22, 24 and channel 38 to open the cigar. The tobacco may then be removed from the cigar and a smaller cigar may be formed.

While the invention has been described in connection with one or more embodiments, it should be understood that the invention is not limited to those embodiments. On the contrary, the invention is intended to cover all alternatives, modifications, and equivalents, as may be included within the spirit and scope of the appended claims.

The invention claimed is:

1. A cigar opener comprising:

a blade housing having a first channel therethrough, said first channel having a blade disposed therein;

a cover having a first opening and a second opening therethrough, wherein said blade housing is rotatable relative to said cover, said blade housing and said cover having a first position wherein said first channel is aligned with said openings and a second position wherein said first channel is not aligned with said openings;

said first channel being cylindrical and having a longitudinal axis coaxial with said first opening and said second opening in said first position; and said blade comprising an elongated blade, wherein said elongated blade is disposed parallel to said longitudinal axis.

2. A cigar opener as recited in claim 1 wherein said first opening and said second opening are circular.

3. A cigar opener as recited in claim 1 wherein said first channel is perpendicular to an axis of rotation.

4. A cigar opener as recited in claim 1 wherein said housing is generally cylindrical in shape.

5. A cigar opener as recited in claim 1 wherein said cover is generally spherical in shape.

6. A cigar opener as recited in claim 1 wherein said blade housing comprises a cylindrical first portion, an integrally formed first flange and a second flange coupled to the cylindrical portion.

7. A cigar opener as recited in claim 6 wherein the second flange is removably coupled to the blade housing.

8. A cigar as recited in claim 7 further comprising a fastener removably coupling said second flange to said blade housing.

9. A cigar opener as recited in claim 6 wherein said cylindrical first portion is rotatably received within a second channel through said cover.

10. A cigar opener as recited in claim 9 wherein said first flange has a first diameter greater than said second channel.

11. A cigar opener as recited in claim 9 wherein said second flange has a first diameter greater than said second channel.

12. A cigar opener comprising:

a blade housing having a first channel therethrough, said first channel having a blade disposed therein;

a cover having a first opening and a second opening therethrough, said cover having a second channel therethrough, said blade housing is rotatable relative to said cover within said second channel about an axis of rotation, said first channel perpendicular to said axis of rotation, said blade housing and said cover having a first position wherein said first channel is aligned with said openings and a second position wherein said first channel is not aligned with said openings.

13. A cigar opener as recited in claim 12 wherein said first channel has a longitudinal axis, wherein said longitudinal axis is coaxial with said first opening and said second opening in said first position.

14. A cigar opener as recited in claim 13 wherein said blade comprises an elongated blade, wherein said elongated blade is disposed parallel to said longitudinal axis.

15. A cigar opener as recited in claim 12 wherein said blade housing comprises a cylindrical first portion, an integrally formed first flange and a second flange coupled to the cylindrical portion.

16. A cigar opener as recited in claim 15 wherein the second flange is removably coupled to the blade housing.

17. A cigar opener as recited in claim 16 further comprising a fastener removably coupling said second flange to said blade housing.

18. A cigar opener as recited in claim 15 wherein said cylindrical first portion is rotatably received within a second channel of said cover.

19. A cigar opener as recited in claim 18 wherein said first flange has a fast diameter greater than said second channel.

20. A cigar opener as recited in claim 18 wherein said second flange has a first diameter greater than said second channel.

21. A method of forming a cigar opener comprising:

providing a blade housing having a first channel therethrough, said first channel having a blade disposed therein;

providing a cover having a first opening and a second opening therethrough;

inserting the blade housing into the cover so that the blade housing is rotatable relative to said cover, said blade housing and said cover having a first position wherein said first channel is aligned with said openings and a second position wherein said first channel is not aligned with said openings;

coupling a flange to the blade housing to retain the blade housing within the cover.

22. A method as recited in claim 21 wherein inserting the blade housing comprises inserting the blade housing into a second channel in said cover.

23. A cigar opener comprising:

a blade housing having a first channel therethrough, said housing being generally cylindrical in shape, and said first channel having a blade disposed therein;

a cover having a first opening and a second opening therethrough, wherein said blade housing is rotatable relative to said cover, said blade housing and said cover having a first position wherein said first channel is aligned with said openings and a second position wherein said first channel is not aligned with said openings.

24. A cigar opener as recited in claim 23 wherein said first opening and said second opening are circular.

25. A cigar opener as recited in claim 23 wherein said first channel is cylindrical having a longitudinal axis, wherein said longitudinal axis is coaxial with said fast opening and said second opening in said first position.

26. A cigar opener as recited in claim 25 wherein said blade comprises an elongated blade, wherein said elongated blade is disposed parallel to said longitudinal axis.

27. A cigar opener as recited in claim 23 wherein said first channel is perpendicular to an axis of rotation.

28. A cigar opener as recited in claim 23 wherein said cover is generally spherical in shape.

* * * * *